US006548954B1

(12) United States Patent
Ishii et al.

(10) Patent No.: US 6,548,954 B1
(45) Date of Patent: Apr. 15, 2003

(54) COLOR CATHODE RAY TUBE WITH BLACK MATRIX HOLES HAVING DIFFERENT DIAMETERS

(75) Inventors: Kazuki Ishii, Sakura (JP); Hirofumi Muto, Sakura (JP)

(73) Assignee: Hitachi Ltd., Tokyo (JP)

( * ) Notice: Subject to any disclaimer, the term of this patent is extended or adjusted under 35 U.S.C. 154(b) by 187 days.

(21) Appl. No.: 09/611,481

(22) Filed: Jul. 7, 2000

(30) Foreign Application Priority Data

Jun. 1, 2000 (JP) ..... 2000-169051

(51) Int. Cl.[7] ..... H01J 29/10

(52) U.S. Cl. ..... 313/467; 313/402; 313/461; 313/408

(58) Field of Search ..... 313/467, 461, 313/463, 472, 402, 408

(56) References Cited

U.S. PATENT DOCUMENTS 3,686,525 A * 8/1972 Naruse et al. ..... 313/402
3,979,630 A * 9/1976 Van Ormer ..... 313/408
4,205,255 A * 5/1980 Tomita ..... 313/470
4,893,054 A * 1/1990 Kobayashi ..... 313/408
5,479,068 A * 12/1995 Muto ..... 313/461
5,604,394 A * 2/1997 Saito et al. ..... 313/422
5,703,431 A * 12/1997 Itou et al. ..... 313/461
5,747,923 A * 5/1998 Beeteson et al. ..... 313/431
6,124,676 A * 9/2000 Salavin et al. ..... 315/169.4
6,177,759 B1 * 1/2001 Beeteson et al. ..... 313/422
6,317,106 B1 * 11/2001 Beeteson et al. ..... 345/74.1

FOREIGN PATENT DOCUMENTS

JP 164143/1988 7/1988
JP 08315747 A * 11/1996
JP 315747/1996 11/1996
JP 63480/1997 3/1997

* cited by examiner

*Primary Examiner*—Ashok Patel
*Assistant Examiner*—Kevin Quarterman
(74) *Attorney, Agent, or Firm*—Milbank, Tweed, Hadley & McCloy LLP

(57) ABSTRACT

A color cathode ray tube has a panel portion in which a black matrix layer and plural phosphor layers are formed on the inner surface of its faceplate. The black matrix layer is provided with first-color holes for a first phosphor layer and second-color holes for a second phosphor layer. The first-color holes and the second-color holes become gradually larger in diameter from the central portion toward the corner portions of the faceplate, and the rate of variation in the diameters of the first-color holes and the rate of variation in the diameters of the second-color holes are different from each other. According to the above-described construction, there is provided a cathode ray tube in which white uniformity is improved over the entire screen.

21 Claims, 16 Drawing Sheets

FIG. 12

| POSITION / WAVELENGTH | CENTRAL PORTION | CORNER PORTION |
|---|---|---|
| 450 (nm) | 78.2 (%) | 68.4 (%) |
| 530 | 78.5 | 68.7 |
| 630 | 76.4 | 65.3 |

COLOR CATHODE RAY TUBE WITH BLACK MATRIX HOLES HAVING DIFFERENT DIAMETERS

BACKGROUND OF THE INVENTION

The present invention relates to a color cathode ray tube and, more particularly, to a color cathode ray tube which is improved in color uniformity over the entire screen.

In recent years, a so-called flat-face or flat-panel type of color cathode ray tube has been widely used as picture tubes for TV receivers or monitor tubes for personal computers. In addition, a color cathode ray tube in which the pitch of phosphor layers is reduced has been provided to display high-resolution images.

The glass-made envelope of such a cathode ray tube includes a panel portion having a faceplate, a neck portion, and a funnel portion which connects the panel portion and the neck portion. The interior of the glass-made envelope is in a nearly vacuum state.

Accordingly, the thickness of each portion of the glass envelope is set to a value which enables the glass envelope to withstand atmospheric pressure. The flat-face type of cathode ray tube in particular is formed in such a manner that the peripheral portion of its faceplate is larger in thickness than the central portion of the faceplate.

In such a cathode ray tube, an electron beam emitted from an electron gun impinges on a phosphor layer formed on the inner surface of the faceplate, thereby making a phosphor emit light. The portion of the faceplate on which picture elements are formed is a screen. Light radiated outward from the outer surface of the faceplate is small in attenuation in the central portion of the faceplate made of glass of small thickness, and is large in attenuation in the peripheral portion of the faceplate made of glass of large thickness. Letting Tpc and Tpa be, respectively, the optical transmissivity of the central portion of the faceplate and the optical transmissivity of the peripheral portion of the faceplate, Tpc>Tpa. In other words, the luminance of an image displayed on the outer surface of the faceplate becomes lower in the peripheral portion than in the central portion of the screen. In addition, in the periphery of the screen, since the weights of phosphors are smaller than those in the center of the screen, the luminance is lowered to a further extent. Japanese Patent Laid-Open No. 238481/1999 (European Patent Laid-Open NO. 0933797) is a document which discloses an art for solving this problem.

If the pitch of the holes of a black matrix (hereinafter, BM holes) for displaying a high-resolution image is made small, the BM holes become small and the luminance is lowered. Since the horizontal pitch of phosphor layers of a recent type of cathode ray tube is 0.3 mm or less, the cathode ray tube is improved in resolution, but is lowered in luminance. If the luminance is low, the range of adjustment of white balance becomes small. In particular, in a case where the thickness of the faceplate is not uniform, since the luminance is partially lowered, it becomes difficult to uniformize white-color display over the entire screen (i.e., white uniformity).

It has been considered that in such a related art cathode ray tube, BM holes for the respective colors are set so that white color can be obtained in the central portion of the screen, and BM holes positioned in the peripheral portion of the screen are made the same in diameter as BM holes positioned in the center of the screen, whereby white-color display becomes uniform over the entire screen. Japanese Patent Laid-Open No. 63480/1997 is a document which discloses this art.

However, in the case of a panel including a flat outer surface and an inner surface having a curved surface, even if the diameters of its BM holes for three colors are made uniform, there occurs the problem that the central and peripheral portions of the screen differ from each other in color temperature. In other words, there occurs the problem that white uniformity cannot be ensured over the entire screen.

SUMMARY OF THE INVENTION

The present inventor has discovered that a cause which makes it impossible to ensure white uniformity is the spectral transmittance of panel glass. That is to say, in a panel having a flat outer surface, since the difference in panel thickness between the central and peripheral portions of the panel, the influence of the difference in the spectral transmittance of the panel between the central portion and the peripheral portion becomes remarkable and degrades white uniformity.

To cope with this subject, the present invention compensates for the difference in the spectral transmittance of panel glass by causing the difference in BM hole diameter between the central portion of a screen and the peripheral portion of the screen, i.e., gradient, to differ among individual colors.

BRIEF DESCRIPTION OF THE DRAWINGS

FIG. 12 is a view showing the measurement results of the spectral transmittance of a panel;

DESCRIPTION OF THE PREFERRED EMBODIMENTS

Preferred embodiments of the present invention will be described below with reference to the accompanying drawings.

Figure 1:
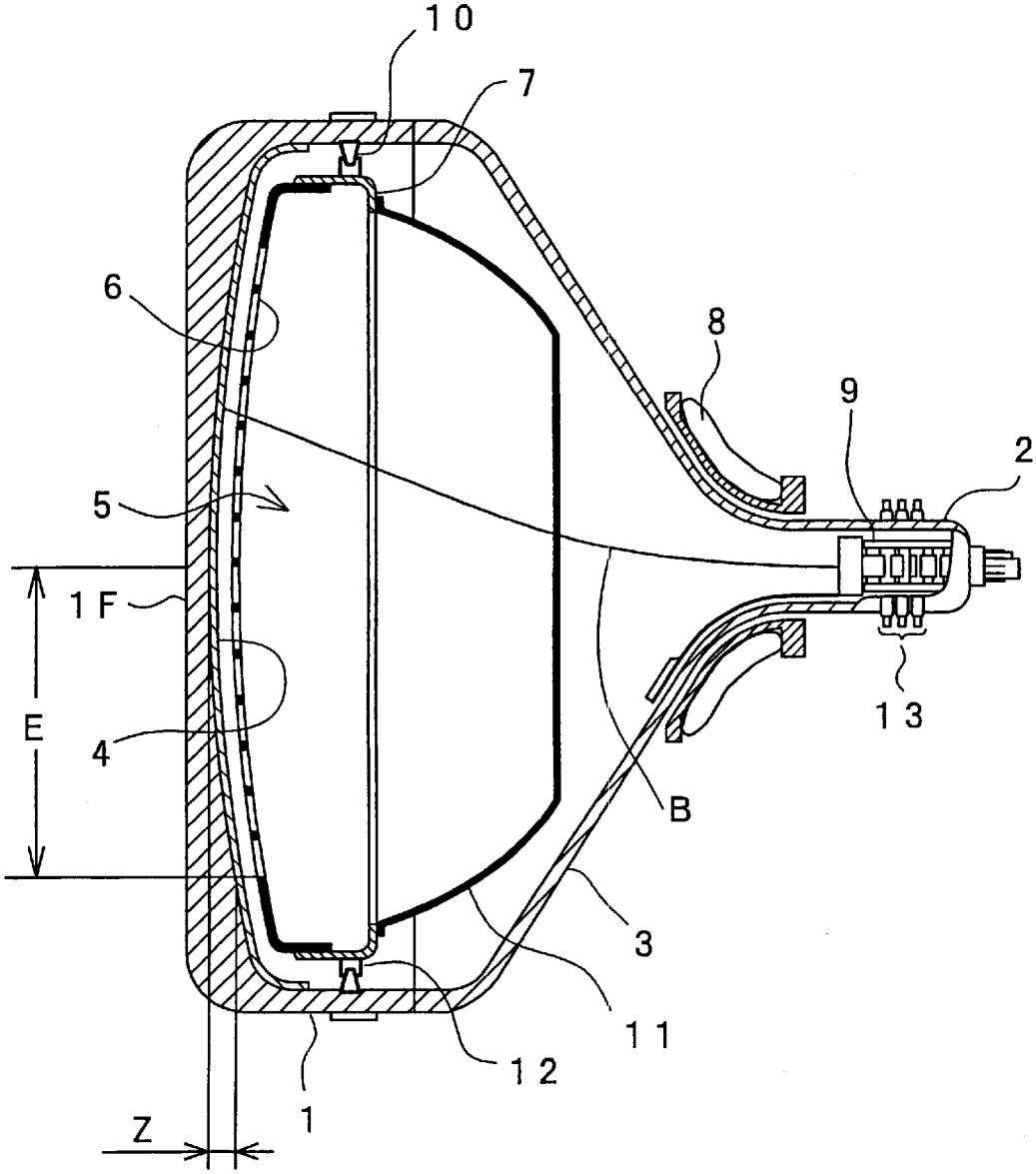
FIG. 1 is a cross-sectional view of a cathode ray tube according to the present invention.

FIG. 1 is a cross-sectional view showing the essential construction of a cathode ray tube according to the present invention.

A glass-made envelope (valve) which constitutes a color cathode ray tube includes a panel portion 1 which is disposed on its front side, an elongated neck portion 2 and a funnel portion 3 which connects the panel portion 1 and the neck portion 2.

The panel portion 1 is provided with a front faceplate 1F and a skirt portion which is connected to the funnel portion 3. The faceplate 1F has a screen 4 on its inner surface, and the screen 4 is formed of a black matrix layer and a phosphor layer.

A tinted panel glass is used for increasing the contrast of an image.

By way of example, Table 1 shows the names of panel glasses normally used, the optical transmissivities of the respective panel glasses (measured with light of wavelength 546 nm for a glass thickness D of 10.16 mm), and the differences in optical transmissivity between the central portions of their faceplates and the peripheral portions of the faceplates.

TABLE 1

| NAME | TRANSMISSIVITY | EIAJ CODE | DIFFERENCE IN TRANSMISSIVITY BETWEEN CENTRAL AND PERIPHERAL PORTIONS OF FACEPLATE |
|---|---|---|---|
| CLEAR | 86% | H8602 | 6.5% |
| | 85.5% | H8603 | 6.5% |
| SEMI-CLEAR | 80% | H8001 | 8% |
| GRAY | 73% | H7302 | 18% |
| TINTED | 56.8% | H5702 | 28.3% |

As panels other than those shown in Table 1, there are a super clear panel of transmissivity 90% (EIAJ code: H9001), a dark tinted panel of transmissivity 46%, and the like.

These transmissivities also vary with the thicknesses of the respective faceplate glasses.

As shown in Table 1, the lower the transmissivity of the panel used, the larger the difference in transmissivity between the central and peripheral portions of the faceplate.

As shown in FIG. 1, in the case of the panel which has a flat outer surface and an inner surface having a curvature, the difference in glass thickness between the central portion and the peripheral portion is remarkably large. If the radius of curvature of the outer surface of the panel is 10,000 mm or more, the difference in the spectral transmittance of the panel glass between the central portion and the peripheral portion becomes large, and white uniformity is degraded.

An equivalent radius of curvature RE is defined as follows by a distance E from the central portion to the peripheral portion of the faceplate 1F and a distance (recession size) Z between the central portion and the peripheral portion in the direction of the tube axis:

$$RE=(Z^2+E^2)/2Z.$$

In the case of an aspherical panel, it is possible to independently set the difference in panel thickness on each of its diagonal, longer and shorter axes, and it is also possible to set the required luminance values in individual portions of the faceplate.

In the cathode ray tube shown in FIG. 1, since the equivalent radius of curvature of the outer surface of the faceplate 1F is larger than the equivalent radius of curvature of the inner surface of the faceplate 1F, the thickness of the peripheral portion of the faceplate 1F is larger than the thickness of the central portion of the faceplate 1F. If the thickness of the peripheral portion of the faceplate 1F becomes 1.2 or more times the thickness of the central portion of the faceplate 1F, it becomes difficult to display uniform white over the entire screen.

An electrode structure for color selection is secured inside the panel portion 1. The shadow mask structure 5 shown in FIG. 1 is the electrode structure for color selection. The shadow mask structure 5 includes a shadow mask 6 having plural electron beam passing holes on the side of the faceplate 1F, a mask frame 7 which holds the shadow mask 6, and a spring 12 fitted into a stud pin 10 and disposed inside the panel.

An internal magnetic shield 11 is provided inside a portion which connects the panel portion 1 and the funnel portion 3. This internal magnetic shield 11 shields external magnetic fields. A deflection yoke 8 is disposed outside a portion which connects the funnel portion 3 and the neck portion 2.

The neck portion 2 which is elongated along the tube axis of the cathode ray tube is housing an electron gun 9. The electron gun 9 emits three electron beams toward the inner surface of the faceplate 1F from three cathodes arranged in an in-line manner.

Three electron beams B (one of which is shown in FIG. 1) emitted from the electron gun 9 are deflected in a predetermined direction by the deflection yoke 8, and impinge on a phosphor film through the shadow mask 6. Magnets 13 for purity adjustment and static convergence adjustment are disposed outside the neck portion 2.

Since the image displaying operation of the color cathode ray tube having the above-described construction is identical to that of a known color cathode ray tube, the description of the image displaying operation of the color cathode ray tube is omitted.

Figure 2:
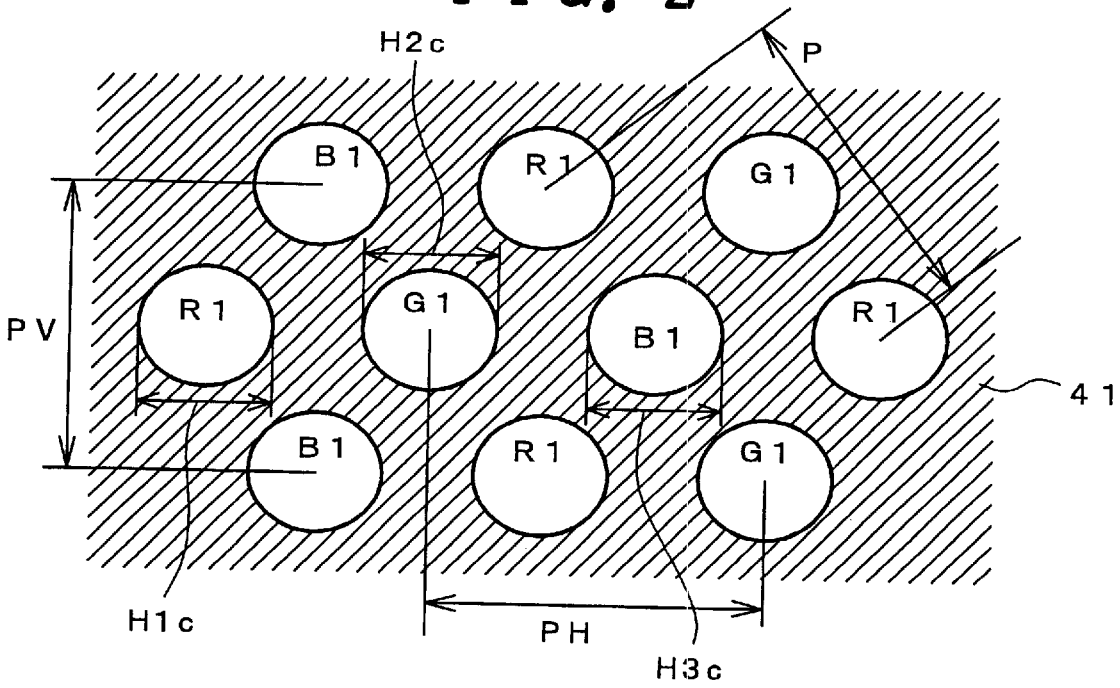
FIG. 2 is a view showing the layout of a black matrix layer and phosphor layers in the central portion of the screen of a color cathode ray tube according to the present invention.

FIG. 2 is a view showing the layout of the black matrix layer (the BM layer) and the phosphor layer with an approximately central portion of the screen being observed from the front side of the faceplate 1F of the cathode ray tube shown in FIG. 1. The faceplate 1F has on its inner surface a BM layer 41, a first-color phosphor layer group RP, a second-color phosphor layer group GP and a third-color phosphor layer group BP. The BM layer 41 absorbs light entering from the outer surface of the faceplate 1F and increases the contrast of an image displayed on the screen. The BM layer 41 has a first-color hole group R for forming the first-color phosphor layer group RP, a second-color hole group G for forming the second-color phosphor layer group GP, and a third-color hole group B for forming the third-color phosphor layer group BP. The individual phosphor layers are formed to cover the respective BM holes. In the central portion of the screen, symbol R1 denotes a first-color hole, symbol G1 denotes a second-color hole, and symbol B1 denotes a third-color hole. The center-to-center distance between vertically adjacent ones of the same-color holes is denoted by a vertical pitch PV, the center-to-center distance between the most closely adjacent ones of the same-color holes is denoted by a hole pitch P, and the horizontal center-to-center distance between the most closely adjacent ones of the same-color holes is denoted by a horizontal pitch PH. Incidentally, since the shapes of the phosphor layers depend on those of the BM holes as observed from the front surface of the faceplate 1F, the following description will be made in connection with the shapes of the BM holes.

As shown in FIG. 2, in the color cathode ray tube, a diameter Hlc of the first-color BM hole R1, a diameter H2*c* of the second-color BM hole G1, and a diameter H3*c* of the third-color BM hole B1 are made approximately equal to one another so that white color can be represented in the central portion of the screen.

Figure 3:
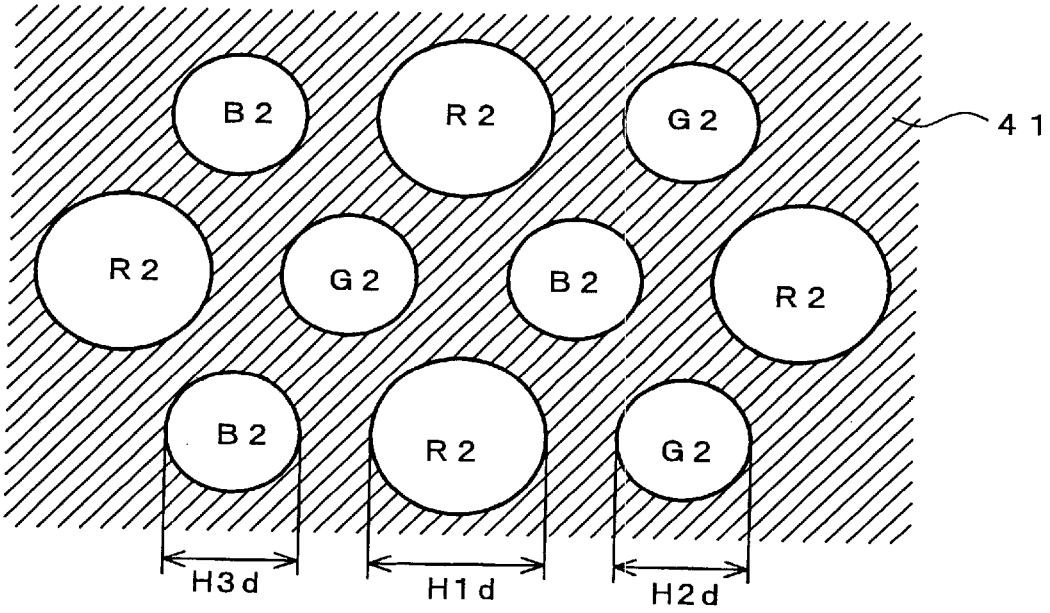
FIG. 3 is a view showing the layout of the black matrix layer and the phosphor layers in a corner portion of the color cathode ray tube according to the present invention.

FIG. 3 is a view showing the layout of the BM layer and the phosphor layer with a diagonal peripheral portion (or corner portion) of the screen being observed from the front side of the faceplate 1F of the cathode ray tube shown in FIG. 1.

A diameter H1*d* of each first-color BM hole R2 positioned in the diagonal peripheral portion is larger than the diameter H1*c* of each of the first-color BM holes R1 positioned in the central portion. In addition, a diameter H2*d* of each second-color BM hole G2 positioned in the diagonal peripheral portion is larger than the diameter H2*c* of each of the second-color BM holes G1 positioned in the central portion, and a diameter H3*d* of each third-color BM hole B2 positioned in the peripheral portion is larger than a diameter H3*c* of each of the third-color BM holes B1 positioned in the central portion.

Moreover, a diameter H1*d* of each of the first-color BM hole R2 positioned in the diagonal peripheral portion is larger than the diameter H2*d* of each of the second-color BM holes G2 positioned in the diagonal peripheral portion as well as the diameter H3*d* of each of the third-color BM holes B2 positioned in the diagonal peripheral portion.

The color cathode ray tube constructed in this manner can display a uniform color over the entire screen even if a panel which does not easily transmit waveforms neighboring those of the first-color phosphors is used. The color cathode ray tube can display uniform white color over the entire screen in particular.

Figure 4:
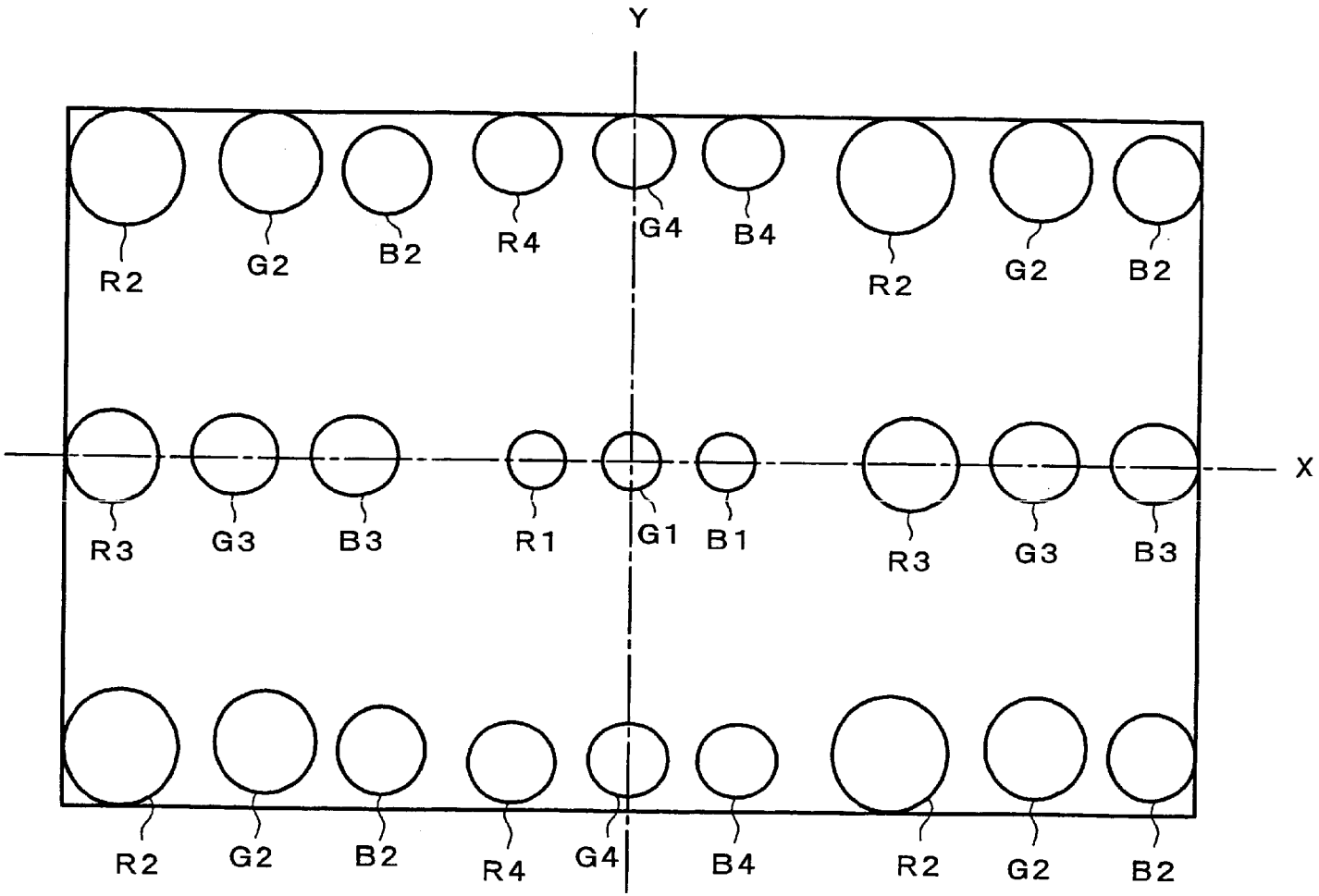
FIG. 4 is a schematic view showing the sizes of BM holes for first-, second- and third-color holes R, G and B of the cathode ray tube.

FIG. 4 is a schematic view showing various sizes of the first-, second- and third-color BM holes R, G and B at different locations on the screen formed on the faceplate of the above-described cathode ray tube. An axis which passes through the center of the faceplate and is parallel to the shorter sides of the faceplate of approximately rectangular shape constitutes the Y axis (or shorter axis), an axis which passes through the center of the faceplate and is parallel to the longer sides of the faceplate constitutes the X axis (or longer axis), and a line which passes through the intersection of the X axis and the Y axis and intersect with the faceplate at right angles constitutes the tube axis of the cathode ray tube.

Referring to FIG. 4, in the central portion of the screen, holes R1, G1 and B1 are a first-color BM hole, a second-color BM hole and a third-color BM hole, respectively. In each diagonal peripheral portion of the screen, holes R2, G2 and B2 are a first-color BM hole, a second-color BM hole and a third-color BM hole, respectively. At the opposite ends of the X axis, holes R3, G3 and B3 are a first-color BM hole, a second-color BM hole and a third-color BM hole, respectively. At the opposite ends of the Y axis, holes R4, G4 and B4 are a first-color BM hole, a second-color BM hole and a third-color BM hole, respectively.

Regarding the holes positioned in the upper right peripheral portion and the upper left peripheral portion, the first-color BM holes R2 are larger in diameter than the first-color BM holes G2.

Since the white uniformity of an image is easily degraded in the diagonal peripheral portions, the following description will be made in connection with the diagonal peripheral portions of the screen.

Moreover, the BM holes are not completely the same in diameter and shape, even if they are the same-color holes, and the shapes of the BM holes are not necessarily round. Therefore, in the present embodiments, the diameters of ten BM holes for each color are averaged. If the BM holes are not round, their longer diameter and shorter diameter are averaged.

In the present embodiments, Panel Evaluation Device MT-5000 which is a CRT panel evaluating system manufactured by MORIKWAWA Seisakusho Corporation is used as an apparatus for measuring the diameters of BM holes. This measuring system measures plural BM holes in a predetermined area and calculates a hole diameter by area conversion.

In the following embodiments, unless otherwise specified, the measuring position in each of the X-axis peripheral portions, the Y-axis peripheral portions and the diagonal peripheral portions is defined as a position which is about 10 mm inward of the outermost hole toward the center of the screen.

Each of the following Embodiments 1 to 4 uses a 51-cm type color cathode ray tube whose effective panel surface has a 508-mm diagonal. The panel used is a semi-clear panel of transmissivity 80%.

A defining equation for the outer and inner surfaces of this panel is as follows:

$$Z_0(X,Y)=Rx-[\{Rx-Ry+(Ry^2-Y^2)^{/1/2}\}^2-X^2]^{1/2}.$$

$Z_0(X, Y)$ represents the recession size from the center of the screen at a position (X, Y) relative to the center of the screen. The outer surface and the inner surface are defined as shown in Table 2.

TABLE 2

| | Rx (mm) | Ry (mm) |
|---|---|---|
| OUTER SURFACE OF PANEL | 50,000 | 80,000 |
| INNER SURFACE OF PANEL | 1,990 | 1,870 |

The equivalent radius of curvature of the panel is defined as shown in Table 3.

The equivalent radius of curvature of the panel is defined as shown in Table 3.

TABLE 3

| | OUTER SURFACE OF PANEL | INNER SURFACE OF PANEL |
|---|---|---|
| THE EQUIVALENT RADIUS OF CURVATURE OF SHORTER-AXIS | 80,000 | 1,870 |

TABLE 3-continued

| | OUTER SURFACE OF PANEL | INNER SURFACE OF PANEL |
|---|---|---|
| DIRECTION (mm) | | |
| THE EQUIVALENT RADIUS OF CURVATURE OF LONGER-AXIS DIRECTION (mm) | 50,000 | 1,990 |
| THE EQUIVALENT RADIUS OF CURVATURE OF DIAGONAL DIRECTION (mm) | 57,800 | 1,950 |

The thickness of the central portion of the panel is 12 mm, and the thickness at a diagonal distance of 240 mm from the central portion is 27 mm.

In the description of each of the following embodiments, the first-color hole group R is referred to as red-color BM holes (hereinafter, red BM holes), the second-color hole group G is referred to as green-color BM holes (hereinafter, green BM holes), and the third-color hole group B is referred to as blue-color BM holes (hereinafter, blue BM holes).

First Embodiment

Figure 5:
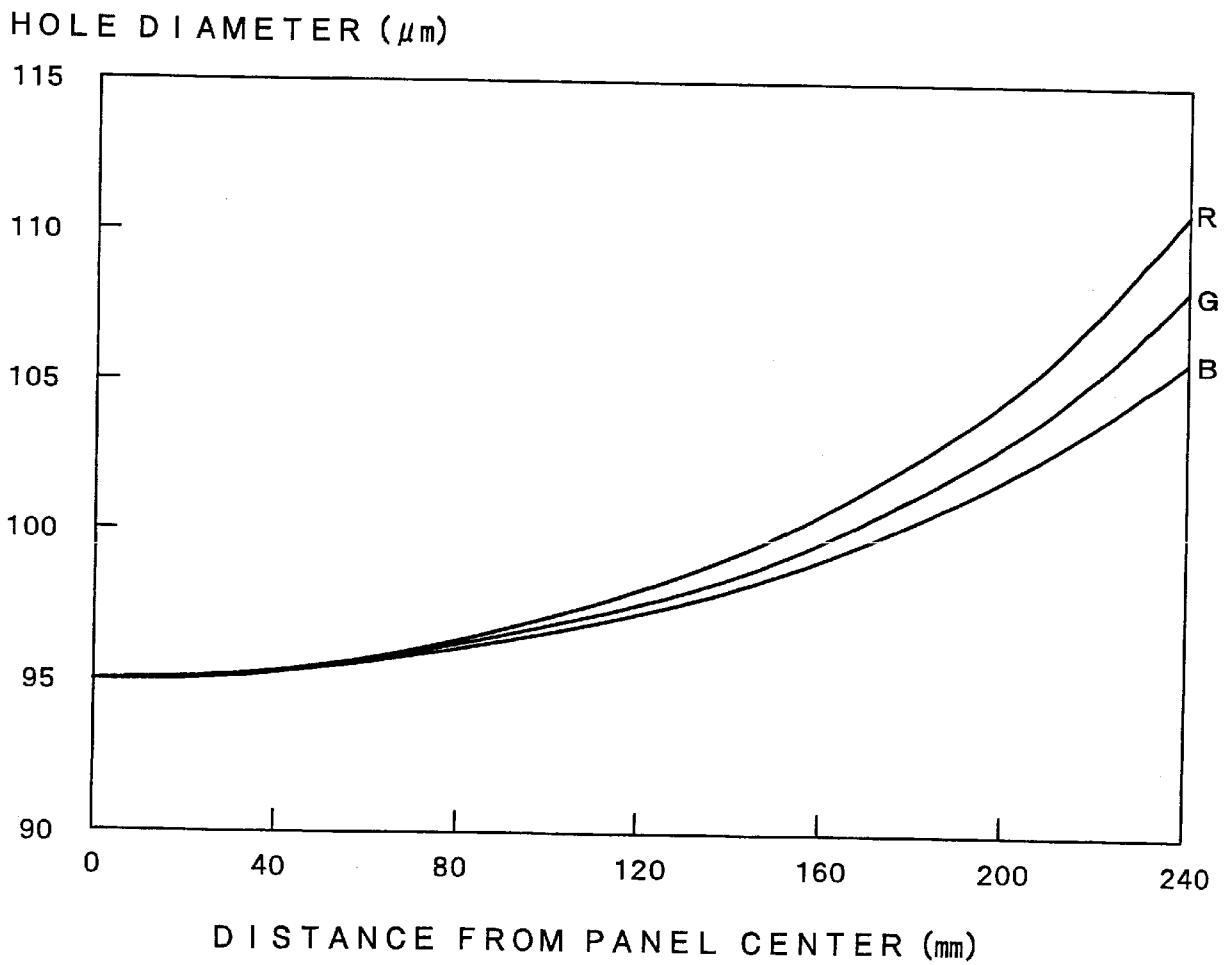
FIG. 5 is a view of a first embodiment, showing variations in the hole diameters of the black matrix of a cathode ray tube to which the present invention is applied.

FIG. 5 is a view showing variations in the diameters of three kinds of BM holes for the respective three colors in a case where the diameters of the three kinds of BM holes are approximately equal to one another in the central portion of the screen and the diameters of the three kinds of BM holes differ from one another in the diagonal peripheral portion of the screen.

The diameters of the red BM holes R, the green BM holes G and the blue BM holes B become gradually larger in directions away from the central portion of the screen.

The ratio of the diameter of the red BM hole R2 positioned in each of the diagonal peripheral portions to that of the red BM hole R1 positioned in the central portion is different from the ratio of the diameter of the green BM hole G2 positioned in each of the diagonal peripheral portions to that of the green BM hole G1 positioned in the central portion ((the diameter H1*d* of the red BM hole R2 positioned in each of the diagonal peripheral portions)/(the diameter H1*c* of the red BM hole R1 positioned in the central portion))≠((the diameter H2*d* of the green BM hole G1 positioned in each of the diagonal peripheral portions)/(the diameter H2*c* of the green BM hole G2 positioned in the central portion)).

In particular, the ratio of the diameter of the red BM hole R2 positioned in each of the diagonal peripheral portions to that of the red BM hole R1 positioned in the central portion is larger than the ratio of the diameter of the green BM hole G2 positioned in each of the diagonal peripheral portions to that of the green BM hole G1 positioned in the central portion ((the diameter H1*d* of the red BM hole R2 positioned in each of the diagonal peripheral portions)/(the diameter H1*c* of the red BM hole R1 positioned in the central portion))>((the diameter H2*d* of the green BM hole G2 positioned in each of the diagonal peripheral portions)/(the diameter H2*c* of the green BM hole G1 positioned in the central portion)).

In the first embodiment, the diameters of the three kinds of BM holes for the respective three colors are made nearly equal to one another in the central portion of the screen, but in the peripheral portion of the screen, the diameters of the red BM holes are made larger than those of the other color BM holes.

In other words, since the rates of increase in the diameters of the BM holes vary for individual phosphor colors from the central portion toward the peripheral portion of the screen, it is possible to uniformly display white color over the entire screen.

Table 4 shows the diameters of the BM holes in the central portion and the diameters of the BM holes in the diagonal peripheral portions in the first embodiment.

TABLE 4

| | DIAMETER OF RED-COLOR BM HOLE (μm) | DIAMETER OF GREEN-COLOR BM HOLE (μm) | DIAMETER OF BLUE-COLOR BM HOLE (μm) |
|---|---|---|---|
| CENTRAL PORTION | 95 | 95 | 95 |
| DIAGONAL PERIPHERAL PORTION | 110 | 107 | 105 |
| (DIAGONAL PERIPHERAL PORTION)/(CENTRAL PORTION) | 1.158 | 1.126 | 1.105 |
| (DIAGONAL PERIPHERAL PORTION) - (CENTRAL PORTION) | 15 | 12 | 10 |

The largest ratio of the absolute amounts of gradient is 15/10=1.5 which is the ratio of the diameters of the red BM holes to those of the blue BM holes. The second largest ratio of the absolute amounts of gradient is 15/12=1.25 which is the ratio of the diameters of the red BM holes to the diameters of the green BM holes.

A more important point in the consideration of the spectral transmittance of the panel is the differences among the ratios ((the diameters of the BM holes positioned in each of the diagonal peripheral portions)/(the diameters of the BM holes positioned in the central portion) of the diameters of the three kinds of BM holes for the respective colors. The difference between the ratio of the diameters of the red BM holes and the ratio of the diameters of the blue BM holes is 1.158−1.105=0.053, i.e., a difference of 5.3%. The difference between the ratio of the diameters of the red BM holes and the ratio of the diameters of the green BM holes is 1.158−1.126=0.032, i.e., a difference of 3.2%.

The first embodiment uses a semi-clear panel in which the thickness of its central portion is 12 mm and the thickness of each of its diagonal peripheral portions is 27 mm. In this case, the difference in thickness between the central portion and the peripheral portion is 15 mm. That is to say, in this case, if the difference in gradient between the diameters of the red BM holes and the diameters of the green BM holes needs only to be about 3%, the problem of white uniformity is approximately solved. In this case, although the difference in gradient is ideally 3%, a great improvement can be achieved even in the case of 1.5% compared to related art examples.

Second Embodiment

Figure 6:
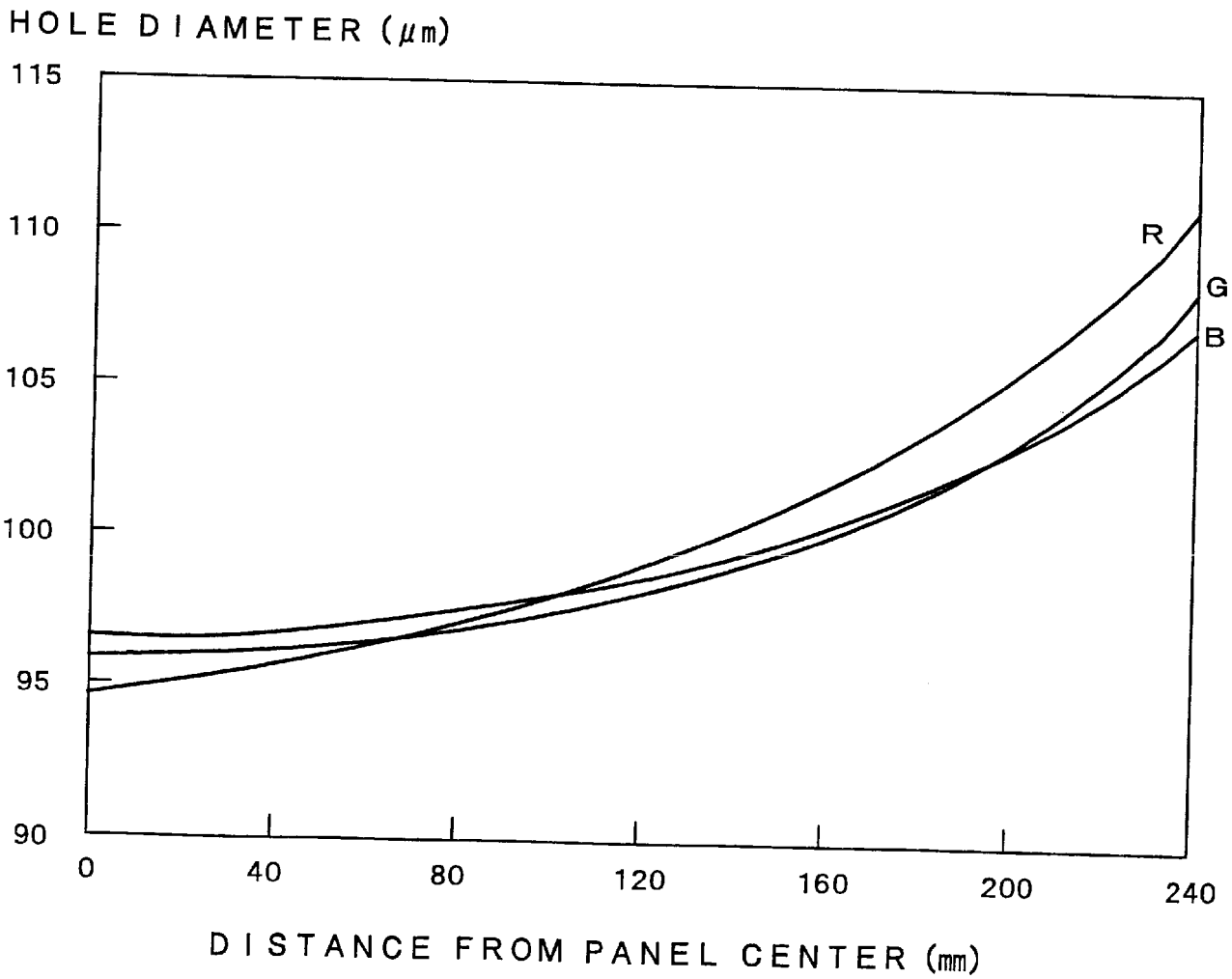
FIG. 6 is a view showing variations in the hole diameters of the black matrix of a second embodiment of the present invention.

FIG. 6 shows the second embodiment. In a cathode ray tube having the variations in hole diameter shown in FIG. 6, in its central portion, the diameter H1*c* of the red BM hole R1, the diameter H2*c* of the green BM hole G1 and the diameter H3*c* of the blue BM hole B1 are different from one another. In addition, in each of its diagonal peripheral portions, the diameter H1*d* of the red BM hole R2, the diameter H2*d* of the green BM hole G2 and the diameter H3*d* of the blue BM hole B2 are different from one another.

The diameters of the red BM holes R, the green BM holes G and the blue BM holes B become curvilinearly gradually larger from the central portion toward the corner portions.

The gradient of the red BM holes is the largest, and the gradients of the other BM holes become smaller in order of the green BM holes and the blue BM holes.

Incidentally, in the central portion, although there are differences among the diameters of the three kinds of BM holes for the respective three colors, the necessary color temperature (white color) can be ensured by adjusting the current ratio (Ik ratio) of the electron beams corresponding to the respective colors.

Since the diameters of the three kinds of BM holes for the respective colors are set according to the spectral transmittance of the panel glass and the emission efficiencies of the phosphors, the Ik ratio of the electron beams for the respective colors can be made small. If the Ik ratio of the electron beams for the respective colors is small, the degradations of the cathodes become uniform. In addition. since the diameters of the three kinds of holes for the respective colors are made different in the central portion, white color can easily be displayed even in the central portion.

The diameter H1*d* of the red BM hole R2 positioned in each of the diagonal peripheral portions is larger than or equal to the diameter H2*d* of the green BM hole G2 positioned in each of the diagonal peripheral portions, and the diameter H1*c* of the red BM hole R1 positioned in the central portion is smaller than the diameter H2*c* of the green BM hole G2 positioned in the central portion.

With this construction, it is possible to reduce the differences in diameter among the three kinds of color holes between the central portion and the diagonal peripheral portions. Since the differences in diameter among the three kinds of color holes are small, the landing margin of the electron beams can easily be ensured.

Third Embodiment

Figure 7:
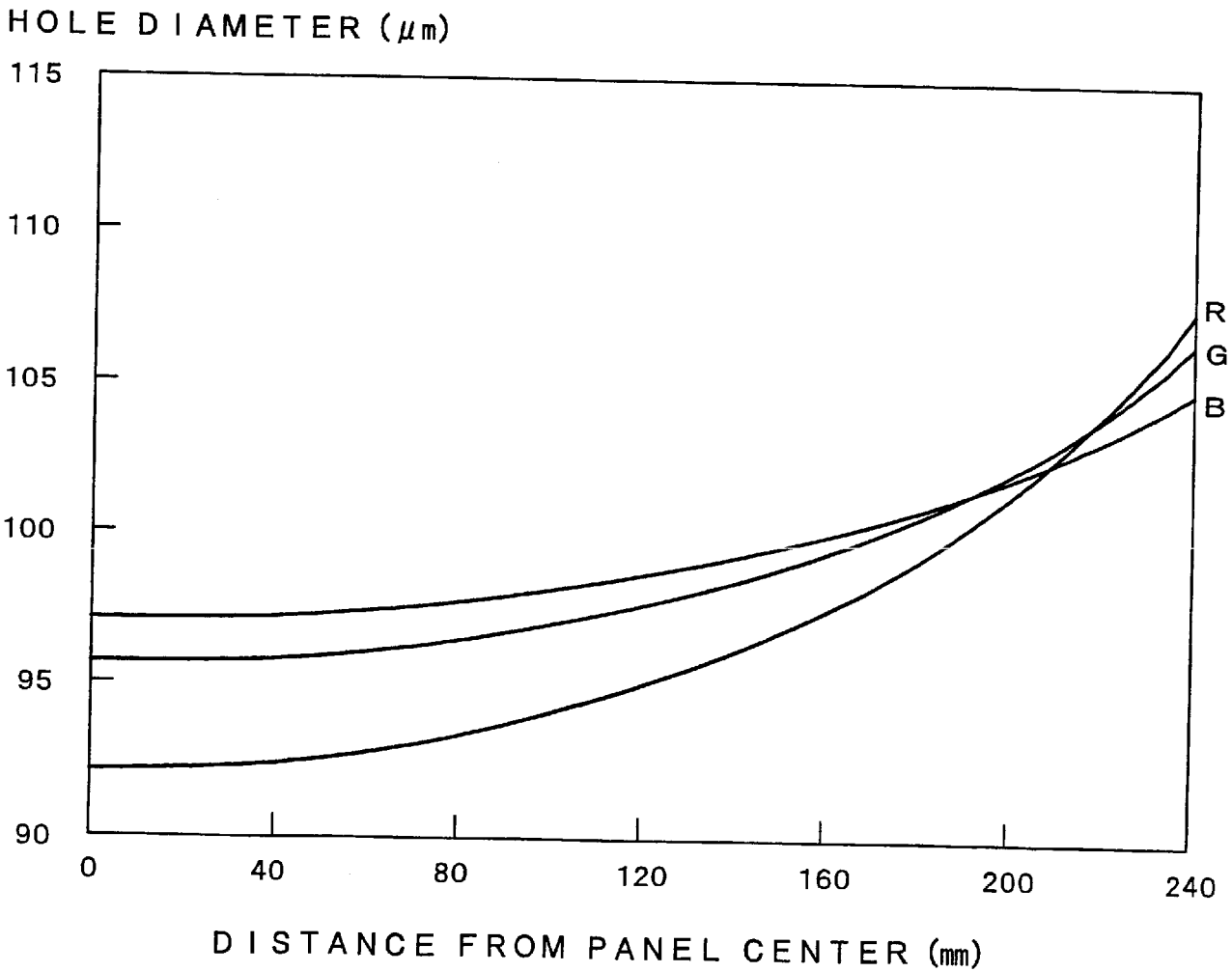
FIG. 7 is a view showing variations in the hole diameters of the black matrix of a third embodiment of the present invention.

FIG. 7 is a view of the third embodiment, showing variations in BM hole diameter.

In a cathode ray tube having the variations in hole diameter shown in FIG. 7, letting H1*c*, H2*c*, H1*d* and H2*d* be, respectively, the diameter of the red BM hole positioned in the central portion, the diameter of the green BM hole positioned in the central portion, the diameter of the red BM hole positioned in each of the diagonal peripheral portions, and the diameter of the green BM hole positioned in each of the diagonal peripheral portions;

$$|H1d-H1c|\neq|H2d-H2c|.$$

In this manner, the difference between the diameter of the red BM hole positioned in the central portion and the diameter of the red BM hole positioned in each of the diagonal peripheral portions is made different from the difference between the diameter of the green BM hole positioned in the central portion and the diameter of the green BM hole positioned in each of the diagonal peripheral portions, whereby it is possible to compensate for the difference in spectral transmittance between the central and peripheral portions of the panel.

Since the panel used in the third embodiment is low in spectral transmittance for red color, the relationship between the BM hole diameters in particular is:

$$|H1d-H1c|>|H2d-H2c|.$$

In addition, the dimensional difference between the smallest and largest ones of the diameters of three adjacent BM holes in the peripheral portion is smaller than the dimensional difference between the smallest and largest ones of the diameters of three adjacent BM holes in the central portion ((the difference in BM hole diameter in the peripheral portion)<(the difference in BM hole diameter in the central portion)).

By reducing the differences among the diameters of the three kinds of holes for the respective three colors are made small in each of the diagonal peripheral portions, it is possible to ensure a margin for the landing positions of the electron beams in each of the diagonal peripheral portions. Accordingly, it is possible to reliably display an image in each of the diagonal peripheral portions. In addition, at this time, in the central portion, because the luminance is high, it is possible to reliably display white color, whereby it is possible to display uniform white color over the entire screen.

In this case as well, the gradient of the red BM holes is the largest, and the gradients of the other BM holes become smaller in order of the green BM holes and the blue BM holes.

Fourth Embodiment

Figure 8:
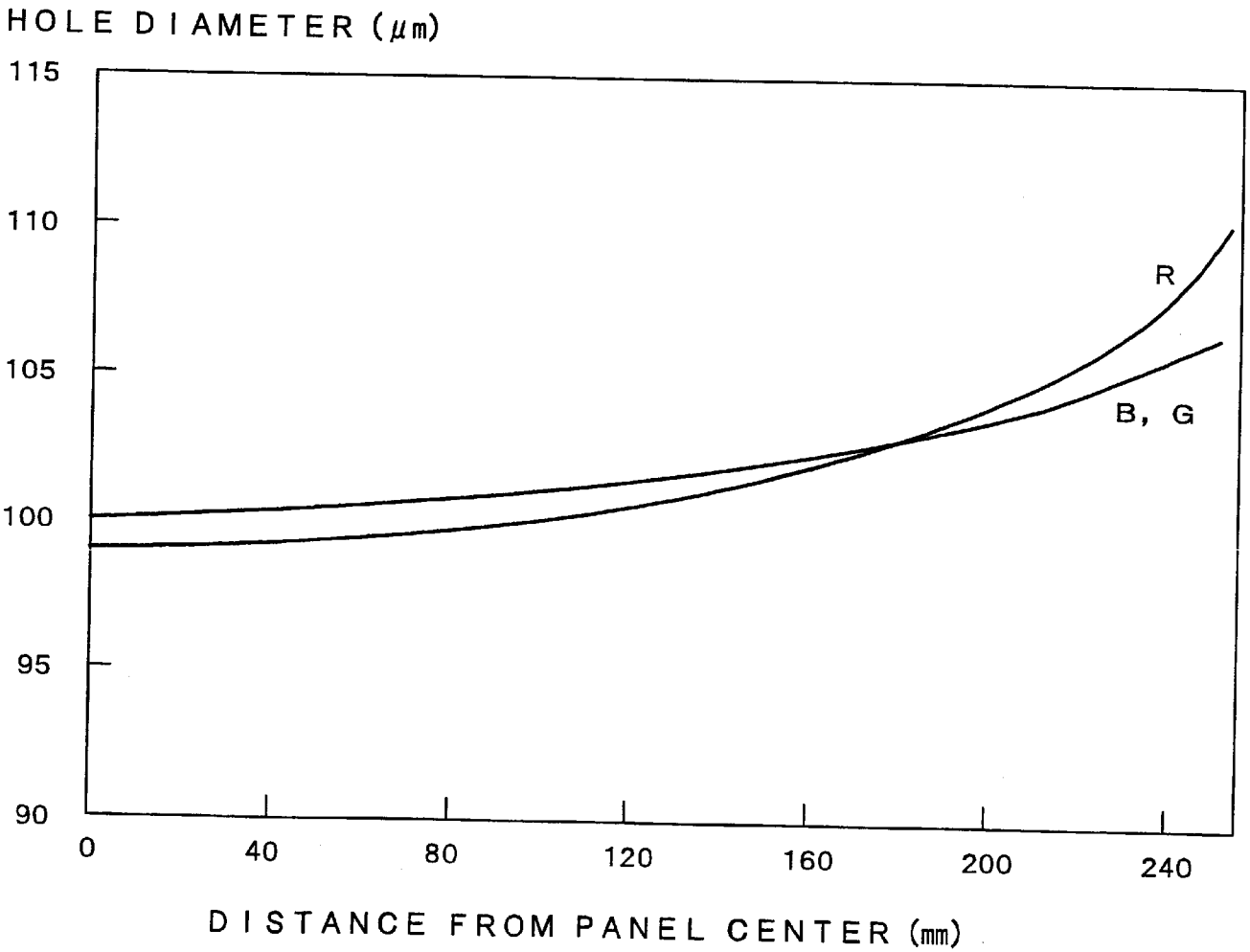
FIGS. 8, 9 and 10 are views respectively showing variations in the hole diameters of the black matrix of a fourth embodiment of the present invention, and showing diagonal, horizontal and vertical variations, respectively.
Figure 9:
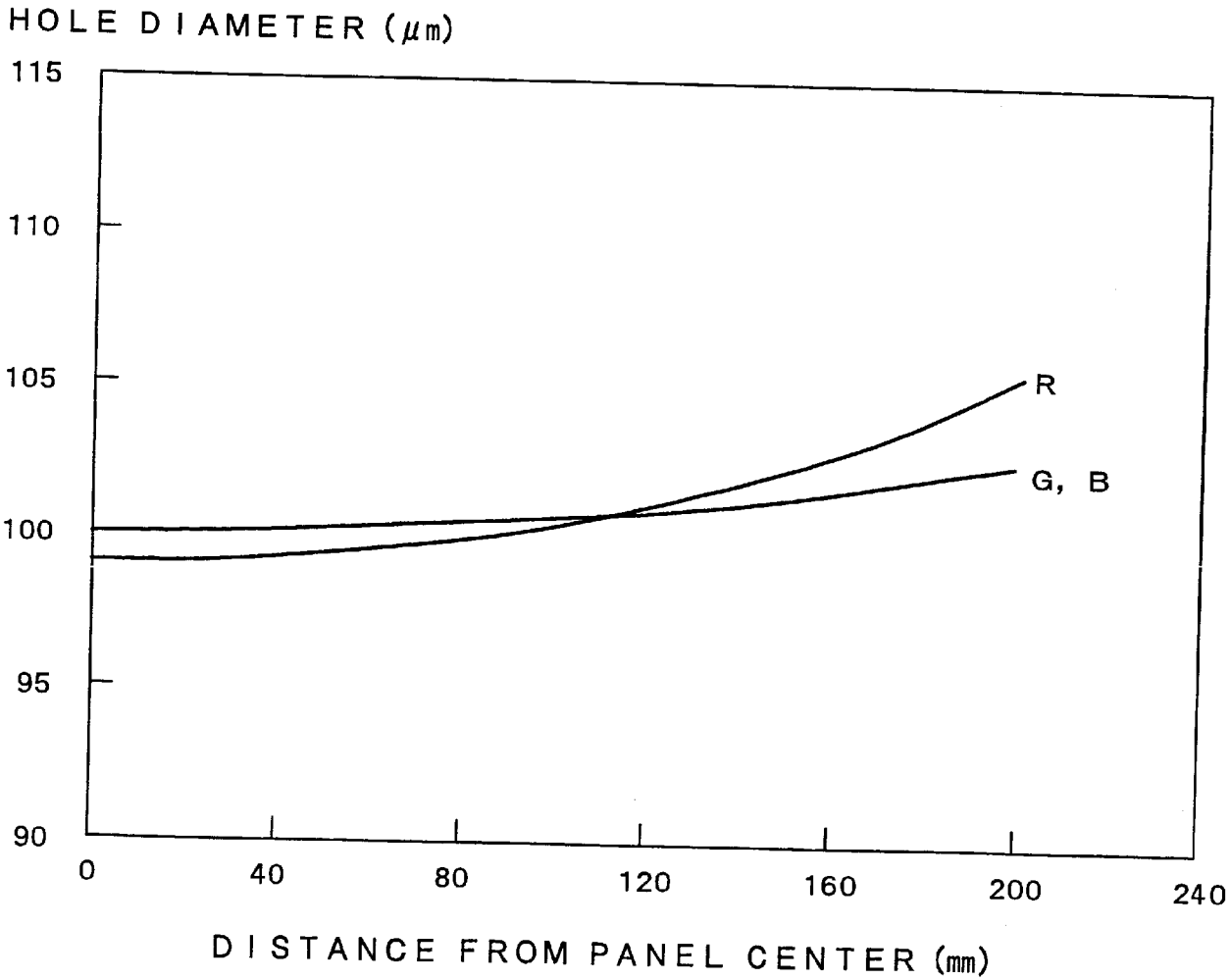
Figure 10:
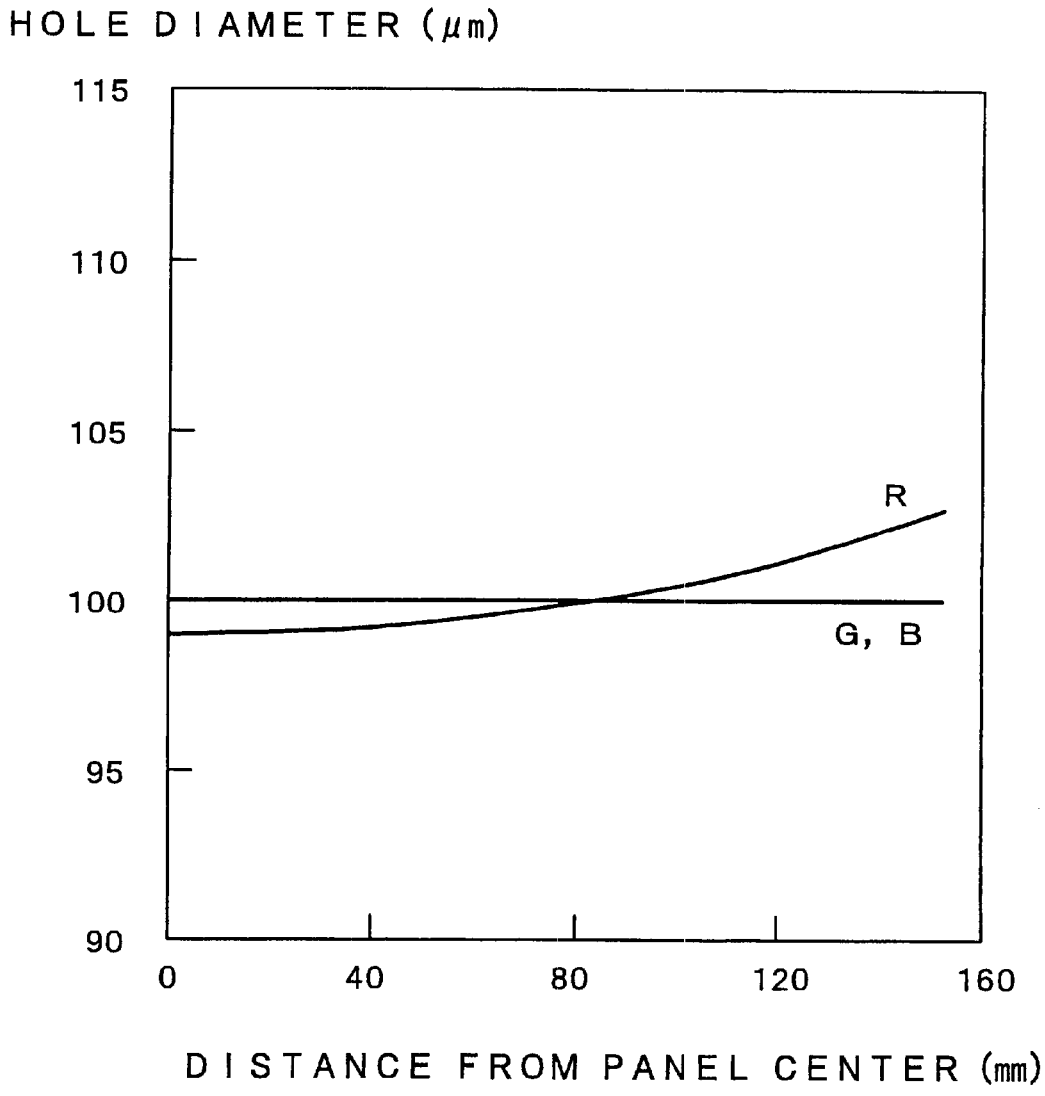

FIGS. 8, 9 and 10 are views of the fourth embodiment, showing variations in black matrix hole diameter, and illustrate variations in the BM hole diameters of a 51-cm type of cathode ray tube.

FIG. 8 shows variations in the BM hole diameters toward the diagonal peripheral portions, FIG. 9 shows variations in the BM hole diameters in the direction of the longer axis, and FIG. 10 shows variations in the BM hole diameters in the direction of the shorter axis. Table 5 shows numerical examples.

TABLE 5

| | DIAMETER OF RED BM HOLE (μm) | DIAMETER OF GREEN BM HOLE (μm) | DIAMETER OF BLUE BM HOLE (μm) |
|---|---|---|---|
| CENTRAL PORTION | 99 | 100 | 100 |
| DIAGONAL PERIPHERAL PORTION (250 mm) | 110 | 107 | 107 |
| (DIAGONAL PERIPHERAL PORTION)/(CENTRAL PORTION) | 1.11 | 1.07 | 1.07 |
| PERIPHERAL PORTION IN THE DIRECTION OF LONGER AXIS (200 mm) | 105 | 102 | 102 |
| (PERIPHERAL PORTION IN THE DIRECTION OF LONGER AXIS)/(CENTRAL PORTION) | 1.06 | 1.02 | 1.02 |
| PERIPHERAL PORTION IN THE DIRECTION OF SHORTER AXIS (150 mm) | 102.6 | 100 | 100 |
| (PERIPHERAL PORTION IN THE DIRECTION OF SHORTER AXIS)/(CENTRAL PORTION) | 1.036 | 1.0 | 1.0 |

FIG. 8 shows variations in the BM hole diameters toward the diagonal peripheral portions. In the direction of the diagonal peripheral portions, there is a difference of about 4% between the rate of variation in the diameter of the red BM hole and the rate of variation in the diameter of the green BM hole as well as the rate of variation in the diameter of the blue BM hole. Incidentally, each of the rates of variation is ((hole diameter in peripheral portion)/(hole diameter in central portion))×100%.

FIG. 9 shows variations in the BM hole diameters in the direction of the longer axis. In the direction of the longer axis, there is a difference of about 4% between the rate of variation in the diameter of the red BM hole and the rate of variation in the diameter of the green BM hole as well as the rate of variation in the diameter of the blue BM hole.

FIG. 10 shows variations in the BM hole diameters in the direction of the shorter axis. In the direction of the shorter axis, there is a difference of about 3.6% between the rate of variation in the diameter of the red BM hole and the rate of variation in the diameter of the green BM hole as well as the rate of variation in the diameter of the blue BM hole.

The difference in gradient of each of the three kinds of color BM holes differs among the diagonal directions, the longer-axis direction and the shorter-axis direction. This is because variations in the thickness of the panel glass differ among the respective directions.

Figure 11:
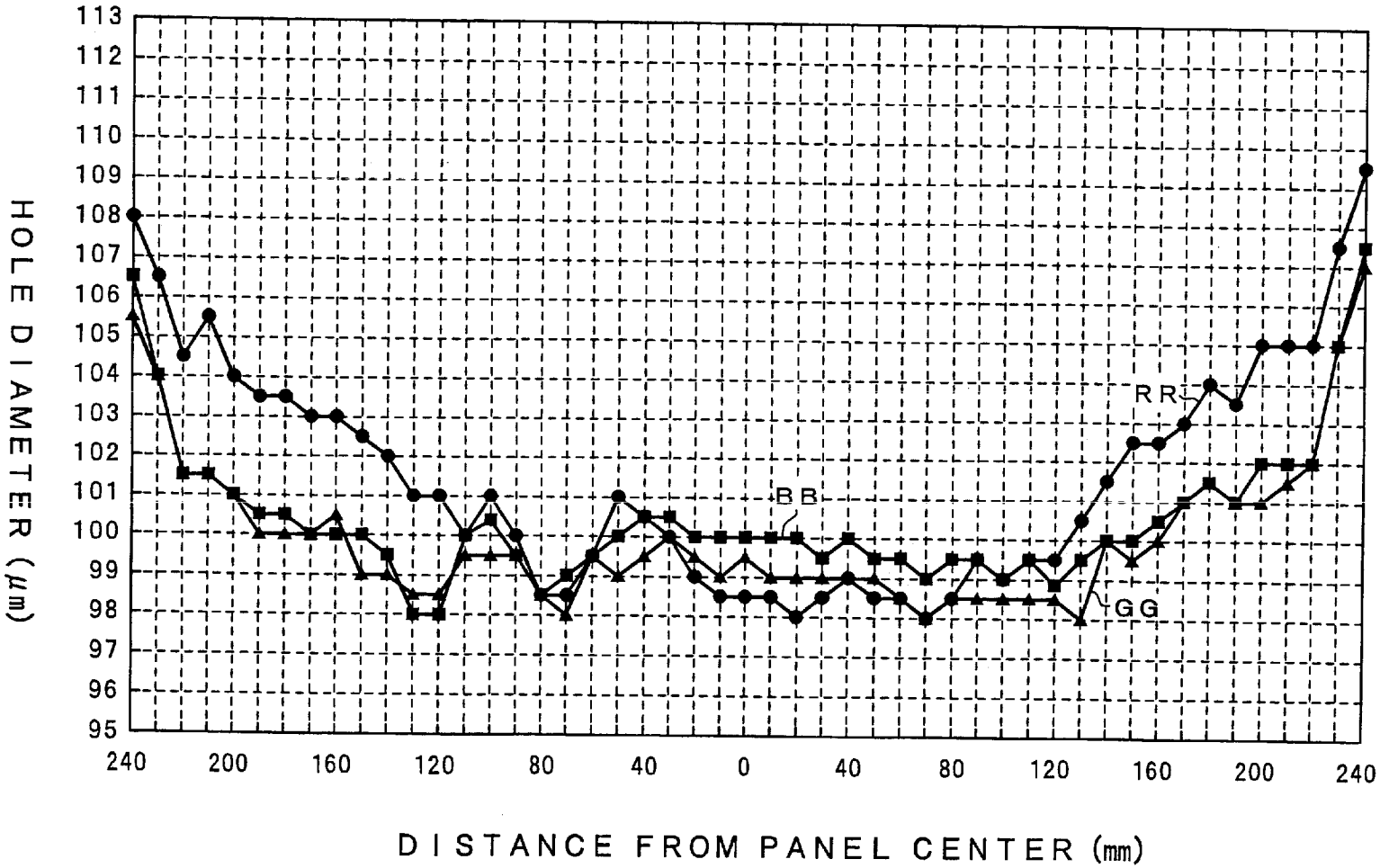
FIG. 11 is a view showing the measurement results of the hole diameters of the black matrix of a 51-cm type cathode ray tube.
Figure 13:
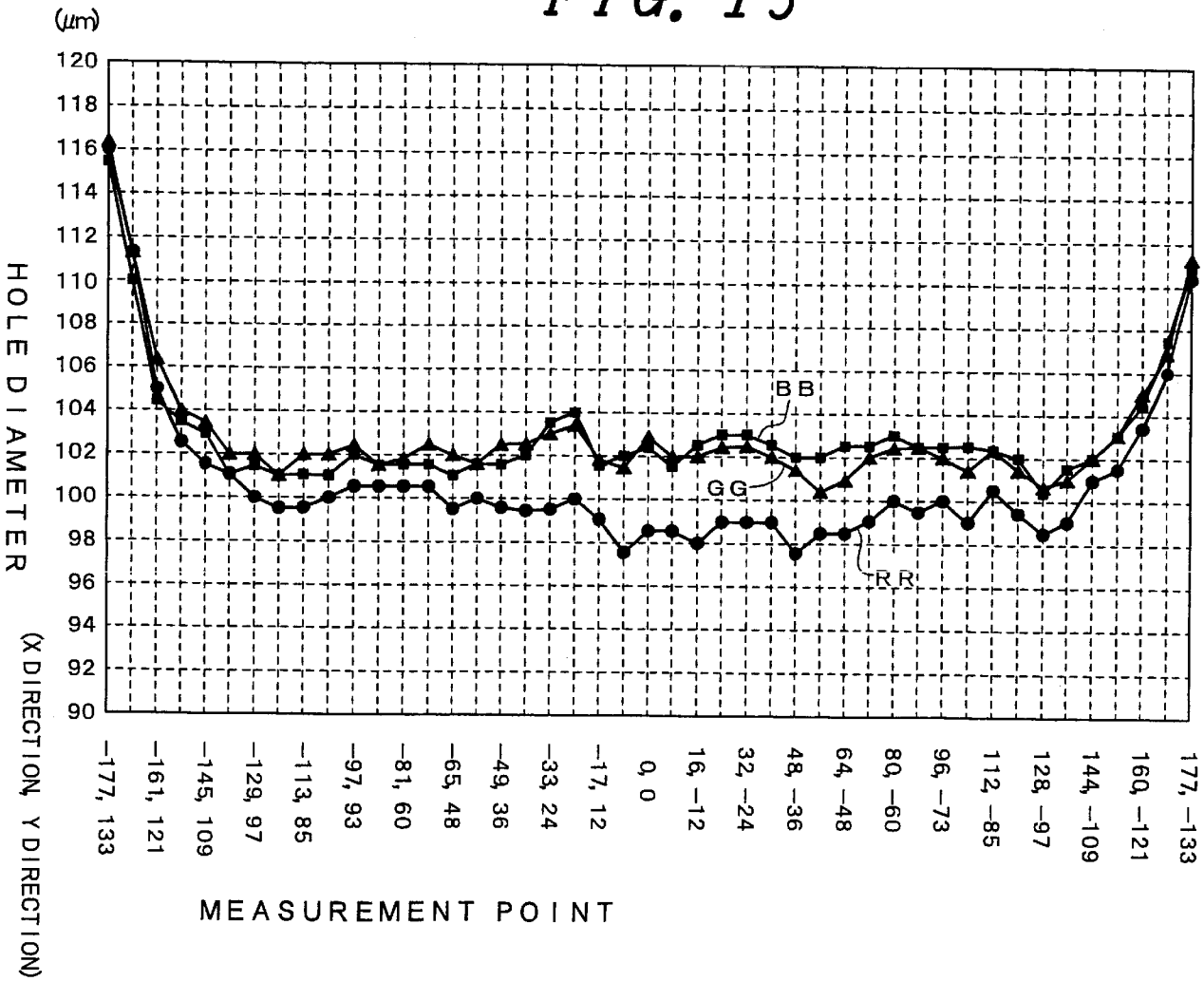
FIG. 13 is a view showing the measurement results of the hole diameters of the black matrix of a 46-cm type cathode ray tube according to a fifth embodiment of the present invention.

FIG. 11 shows the measured values of hole diameters of a 51-cm type cathode ray tube manufactured on the basis of the above-described design values. Measurements were performed in the direction of the diagonal directions of the screen. In FIG. 13, the ordinate represents the BM hole diameters, while the abscissa represents the distances from the center of the screen. A line RR represents a variation in the diameter of the red BM hole, a line GG represents a variation in the diameter of the green BM hole, and a line BB represents a variation in the diameter of the blue BM hole.

Table 6 shows the BM hole diameters in the respective portions.

TABLE 6

| | DIAMETER OF RED BM HOLE (μm) | DIAMETER OF GREEN BM HOLE (μm) | DIAMETER OF BLUE BM HOLE (μm) |
|---|---|---|---|
| CENTRAL PORTION | 98.5 | 99.5 | 100 |
| UPPER LEFT DIAGONAL PERIPHERAL PORTION | 108 | 105.5 | 106.5 |
| (UPPER LEFT DIAGONAL PERIPHERAL PORTION)/(CENTRAL PORTION) | 1.096 | 1.06 | 1.065 |
| LOWER RIGHT DIAGONAL PERIPHERAL PORTION | 109.5 | 107 | 107.5 |
| (LOWER RIGHT PERIPHERAL PORTION)/(CENTRAL PORTION) | 1.112 | 1.075 | 1.075 |

In the upper left diagonal peripheral portion, the difference between the rate of variation in the diameter of the red BM hole and the rate of variation in the diameter of the green BM hole or the rate of variation in the diameter of the blue BM hole is about 3.1–3.6%.

In the lower right diagonal peripheral portion, the difference between the rate of variation in the diameter of the red BM hole and the rate of variation in the diameter of the green BM hole or the rate of variation in the diameter of the blue BM hole is about 3.7%.

In the fourth embodiment, since the manufacturing error of black matrix holes is about ±5 μm, the BM holes are generally larger in the lower right diagonal peripheral portion than in the upper left diagonal peripheral portion.

However, since the manufacturing error of each of the BM holes for the respective colors is less than about ±1 μm, the difference between the diameter of the red BM hole and each of the green BM hole and the blue BM hole is 3.1–3.6% in the upper left corner portion of the screen, and 3.7% in the lower right corner portion of the screen.

In the above-described fourth embodiment, the diameter of the first-color BM hole R1 and each of the diameter of the second-color BM hole G1 and the diameter of the third-color BM hole B1 differ from each other in the central portion of the screen, the diameters of these three kinds of BM holes may also be made to differ from one another.

According to the fourth embodiment, the diameters of the three kinds of BM holes for the respective colors vary in different manners in each of the diagonal, longer-axis and shorter-axis directions. With the above-described construction, it is possible to display uniform white color over the entire screen.

In addition, since the difference between the rate of variation in the diameter of the red BM hole and the rate of variation in the diameter of the green BM hole or the rate of variation in the diameter of the blue BM hole is 3.0% or more, it is possible to correct the unevenness of color in the peripheral portion of the screen and it is possible to display uniform white color over the entire screen.

Letting H1*c*, H1*d*, H2*c* and H2*d* be, respectively, the diameter of the first-color BM hole positioned in the central portion, the diameter of the first-color BM hole positioned in the peripheral portion, the diameter of the second-color BM hole positioned in the central portion, and the diameter of the second-color BM hole positioned in the peripheral portion, if $|H1d-H1c|/H1c$ is larger than $|H2d-H2c|/H2c$ by 1.5% or more, as compared with related art examples, it is possible to partially solve the unevenness of color caused by the difference in spectral transmittance due to the difference in thickness of the panel glass.

Fifth Embodiment

FIGS. 12 and 13 show the fifth embodiment.

The fifth embodiment will be described with reference to a cathode ray tube in which its effective diameter is 46 cm and its panel has a flat outer surface and a curved inner surface. The panel of this cathode ray tube is a semi-clear panel of transmissivity 80%.

A defining expression for the outer and inner surfaces of this panel is as follows:

$$Z_0(X,Y)=Rx-[\{Rx-Ry+(Ry^2-Y^2)^{1/2}\}^2-X^2]^{1/2}.$$

$Z_0(X, Y)$ represents the recession size from the center of the screen at a position (X, Y) relative to the center of the screen. The outer surface and the inner surface are defined as shown in Table 7.

TABLE 7

| | Rx (mm) | Ry (mm) |
|---|---|---|
| OUTER SURFACE OF PANEL | 50,000 | 80,000 |
| INNER SURFACE OF PANEL | 1,650 | 1,790 |

The thickness of the central portion of the panel is 11.5 mm, the thickness of each of the diagonal peripheral portions is 21.9 mm, and (the thickness of each of the diagonal peripheral portions)/(the thickness of the central portion) ≅1.9.

FIG. 12 shows the measurement results of the spectral transmittance of the panel of the cathode ray tube.

In this panel, its spectral transmittance for red is lower than its spectral transmittances for the other colors. In this panel, the transmissivity of wavelengths near red color is low.

In the central portion of the measured panel, the difference between the transmissivity of light of wavelength 530 nm and the transmissivity of light of wavelength 630 nm is about 2.1%. In addition, in each of the diagonal peripheral portions of the panel, the difference between the transmissivity of light of wavelength 530 nm and the transmissivity of light of wavelength 630 nm is 3.4%. That is to say, the transmissivity of light of wavelength 530 nm has a difference of about 9.7% between the each of the diagonal peripheral portions and the central portion, and the transmissivity of light of wavelength 630 nm has a difference of about 11.1% between the each of the diagonal peripheral portions and the central portion.

FIG. 13 shows the measurement results of the BM hole diameters of the above-described 46-cm type of cathode ray tube, and shows the BM hole diameters and diagonal gradients. In the fifth embodiment, the diameters of the three kinds of BM holes for the respective colors are approximately the same in each of the diagonal peripheral portions, whereas in the central portion, there are differences among the diameters of the three kinds of BM holes for the respective colors.

In FIG. 13, the BM hole diameters are plotted against the ordinate, and measurement positions are plotted against the abscissa. The center of the measurement positions is (0, 0), i.e., (a distance in the longer-axis direction (mm), a distance in the shorter-axis direction (mm)), and the diameters of the BM holes were measured in the diagonal directions. The line RR represents a variation in the diameter of the red BM hole, the line GG represents a variation in the diameter of the green BM hole, and the line BB represents a variation in the diameter of the blue BM hole. Each of a red-BM-hole diameter R1L, a green-BM-hole diameter G1L and a blue-BM-hole diameter B1L varies within about 2 μm up to a diagonal position about 160 mm away from the center of the screen, and varies by 8 μm or more from a diagonal position of 160 mm to a position of about 220 mm.

In the central portion, the red-BM-hole diameter R1L is about 98.5 μm, the green-BM-hole diameter G1L is about 103 μm, and the blue-BM-hole diameter B1L is about 102.5 μm. In the lower right diagonal peripheral portion, a red-BM-hole diameter R21L is about 110.5 μm, a green-BM-hole diameter G21L is about 111.5 μm, and a blue-BM-hole diameter B21L is about 111 μm. In the upper left diagonal peripheral portion, a red-BM-hole diameter R22L is about 116 μm, a green-BM-hole diameter G22L is about 115.5 μm, and a blue-BM-hole diameter B22L is about 116.5 μm. In the central portion, the difference between the red-BM-hole diameter R1L and the green-BM-hole diameter G1L is about 4.5 μm. In the lower right diagonal peripheral portion, the difference between the red-BM-hole diameter R21L and the green-BM-hole diameter G21L is about 1 μm. In the upper left diagonal peripheral portion, the difference between the green-BM-hole diameter G22L and the blue-BM-hole diameter B22L and is about 1 μm.

In the cathode ray tube having such variations, since the differences among the three kinds of BM hole diameters for the respective colors are small in the peripheral portion the landing margins of the electron beams for the respective colors can be made approximately equal.

In addition, according to the present invention, it is possible to improve the color uniformity of white color in the central and peripheral portions of the screen.

Sixth Embodiment

Figure 14:
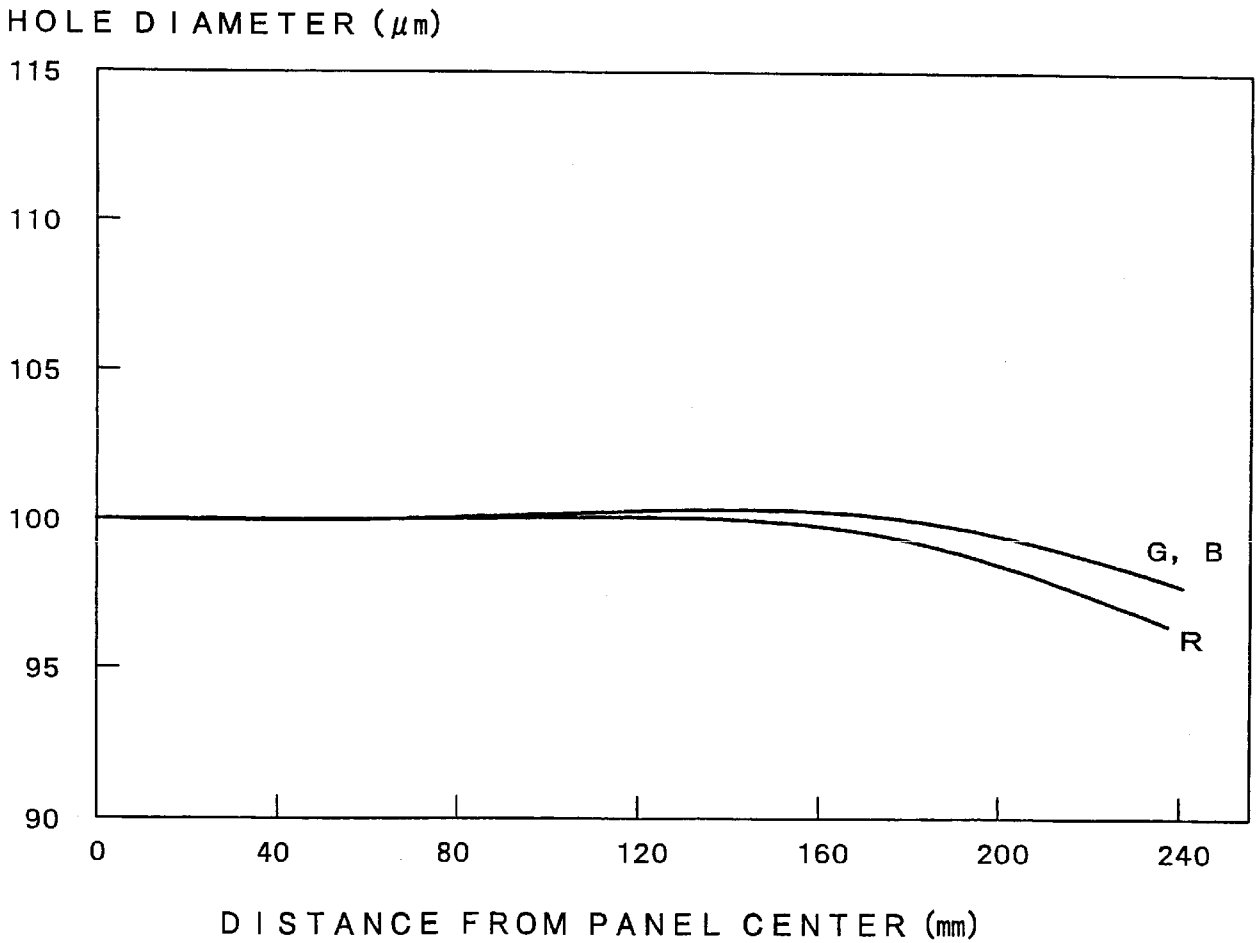
FIG. 14 is a view showing variations in the diameters of black matrix holes in the long-axis direction of the screen of a sixth embodiment of the present invention.
Figure 15:
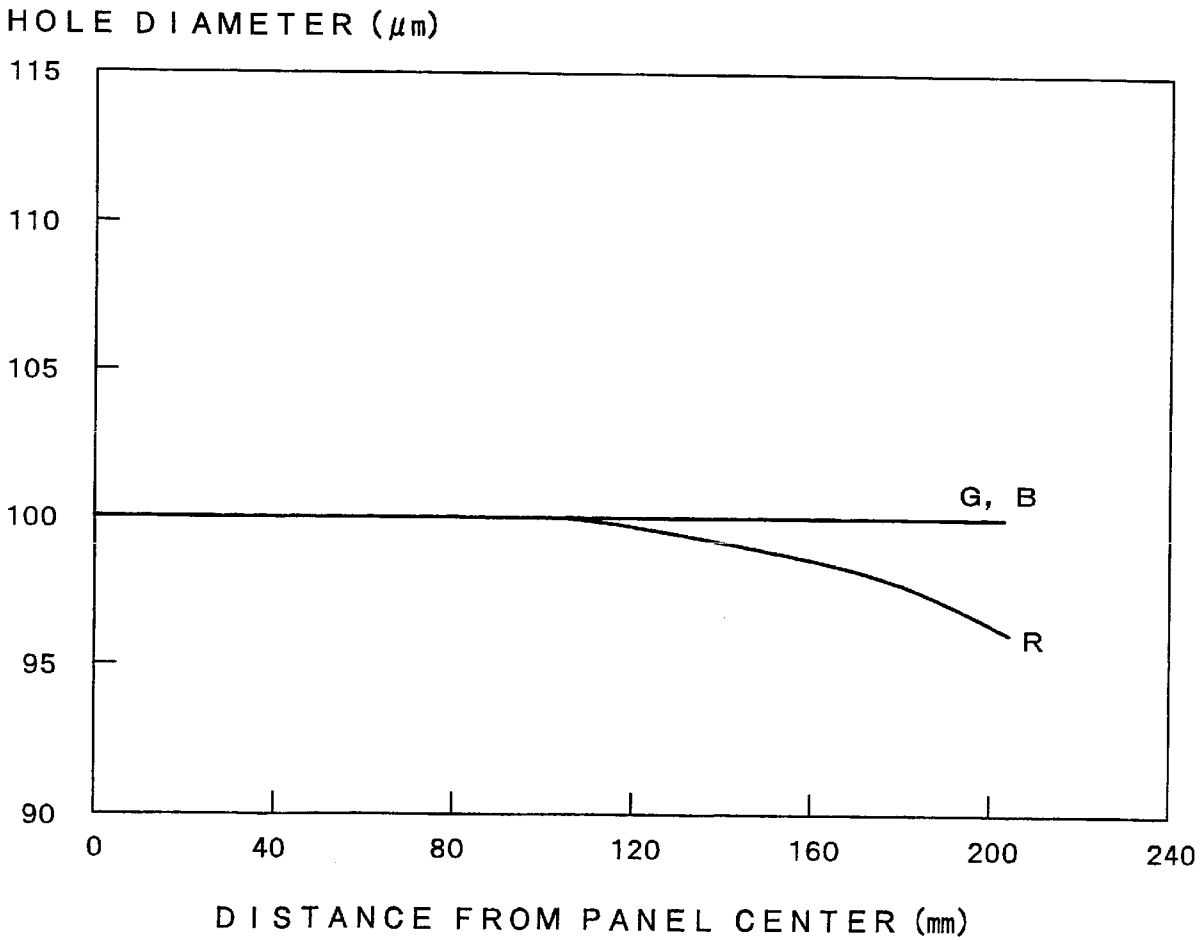
FIG. 15 is a view showing variations in the diameters of black matrix holes in each diagonal direction of the screen of the sixth embodiment of the present invention.

FIGS. 14 and 15 show the sixth embodiment. FIG. 14 shows the gradients of BM holes in the longer-axis direction. FIG. 15 shows the gradients of the BM holes in each of the diagonal directions.

In the longer-axis direction, the diameter of the red BM hole becomes smaller toward the peripheral portion, while the diameters of the green and blue BM holes are approximately the same in both the central portion and the peripheral portion.

In each of the diagonal peripheral directions, the diameters of the red BM hole, the green BM hole and the blue BM hole become smaller toward the peripheral portion. The rate of variation in the diameter of the red BM hole is larger than that of the diameter of each of the green and blue BM holes.

As shown in FIGS. 14 and 15, in a shadow mask whose electron beam passing holes become smaller in diameter toward its peripheral portion, there is a case in which the BM hole diameters are made smaller in the peripheral portion than in the central portion. In this case as well, there may be a difference between the rate of variation in the diameter of the red-color BM hole and the rate of variation in the diameter of the green- or blue-color BM hole.

With this construction, it is possible to display uniform white color over the entire screen.

In addition, if the BM holes of a cathode ray tube in which the peripheral portion of its screen is smaller in thickness than the central portion of the screen have the variations shown in FIG. 14, it is possible to display uniform white color over the entire screen.

Seventh Embodiment

A method of ma manufacturing a cathode ray tube will be described below as the seventh embodiment.

First of all, a BM layer is formed on the inner surface of a faceplate, and various phosphor layers are formed.

Figure 16:
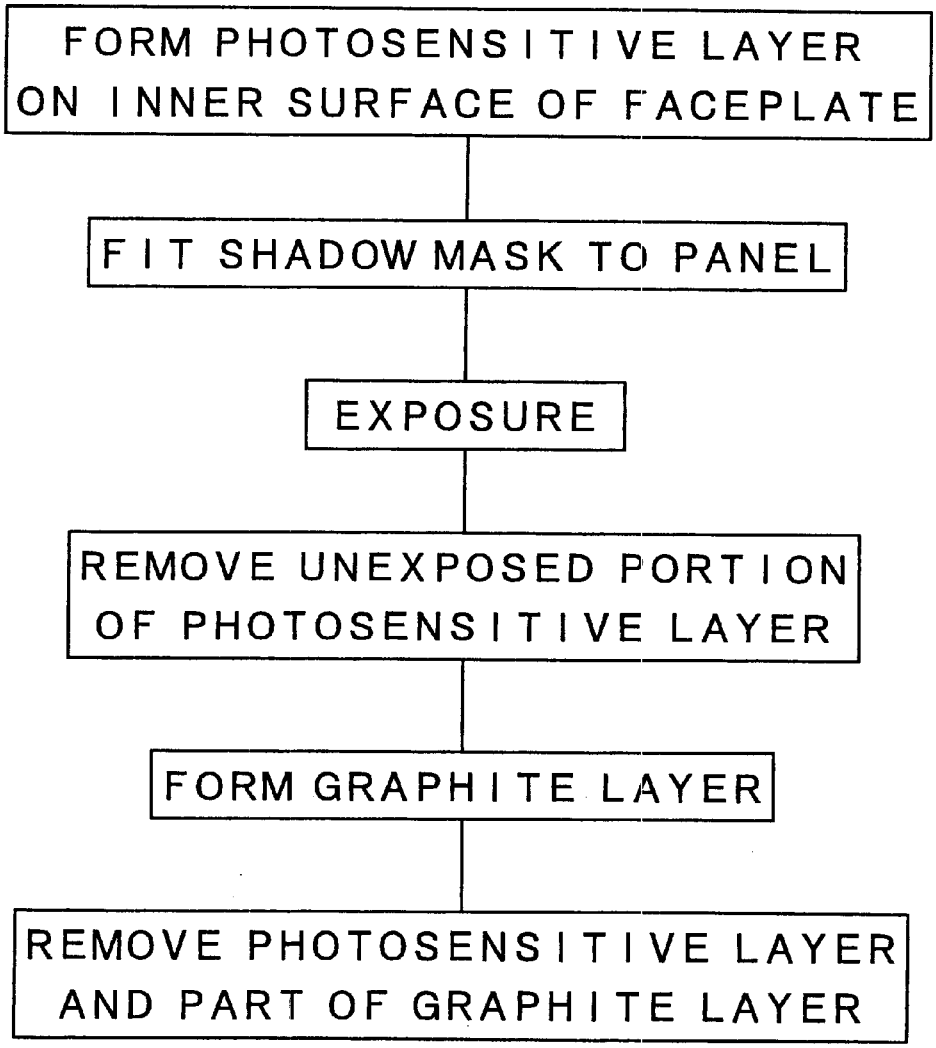
FIG. 16 is a flowchart showing the process of manufacturing a black matrix layer.

FIG. 16 is a flowchart of a process for forming a black matrix. A black matrix on the inner surface of a panel is formed in the following process. First, the inner surface of the panel is applied to a photosensitive material, thereby forming a photosensitive layer.

Then, a shadow mask is fitted to the panel, and the photosensitive is exposed through the holes of the shadow mask. This exposure is performed three times according to the number of electron beams. During the exposure, a light source and several lenses and filters are made to travel in compliance with an electron beam pitch so as to follow an actual electron beam path.

Then, the unexposed portion of the photosensitive layer is removed, and graphite is applied to the photosensitive layer and is then dried to form a graphite coating layer.

Then, the remaining photosensitive layer and the graphite deposited thereon are removed to form a black matrix layer having multiple holes.

Figure 17:
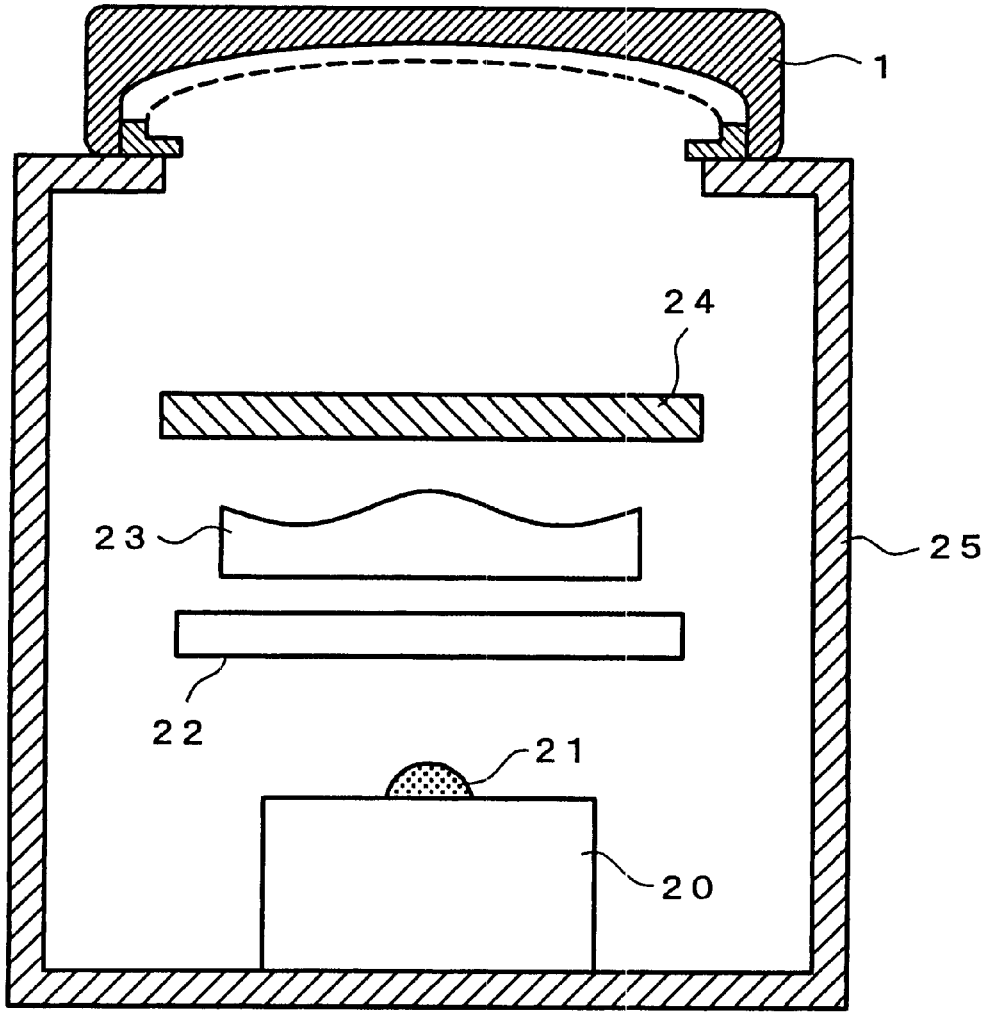
FIG. 17 is a view showing an exposure apparatus for forming a black matrix according to the present invention.

FIG. 17 shows an exposure apparatus for forming the above-described BM layer of the cathode ray tube.

A lamp house 20 is installed inside an exposure base 25, and exposure light is emitted from a window 21 of the lamp house 20. In addition, a common grading filter 22, a correcting lens 23 and a particular-color grading filter 24 are installed inside the exposure base 25. Each of the filters 22 and 24 has a construction in which a filtering film is formed on a glass substrate.

The common grading filter 22 is used in common when first-color holes, second-color holes and third-color holes are to be formed. The common grading filter 22 is lower in transmissivity in its central portion and higher in transmissivity in its peripheral portion. The common grading filter 22 having this construction is capable of controlling the relative sizes of the holes between the central and peripheral portions of the screen, whereby it is possible to form larger holes nearer to the peripheral portion of the screen.

The particular-color grading filter 24 is one of a first-color hole grading filter, a second-color hole grading filter and a third-color hole grading filter, and when each kind of hole is to be formed, the corresponding grading film is used. Otherwise, the particular-color grading filter 24 may use only the first-color hole grading filter or the first-color hole grading filter and the second-color hole grading filter.

In a case where only the first-color hole grading filter is used, a transparent glass substrate having no grading filter is used for the other colors so that the refractive indices of the substrates are matched. With this construction, it is possible to easily form the first-color holes having a rate of variation different from the other-color holes.

In addition, by applying the above-described art to the exposure apparatus described in Japanese Patent Laid-Open No. 63480/1997, it is possible to make the rate of increase in the diameters of the same-color holes equivalent on both right and left sides of the screen.

Although the above description of the embodiments has referred to the art of improving white uniformity over the entire screen, it is also possible to improve color uniformity over the entire screen.

Although the above description has referred to a cathode ray tube of the type in which the thickness of the peripheral portion of its faceplate is large and the thickness of the central portion of the faceplate is small, the present invention may also be applied to a faceplate which is thick in its central portion and thin in its peripheral portion. In addition, the present invention makes it possible to control the amount of variation in the hole diameters of holes of each kind corresponding to a particular phosphor.

According to the present invention, it is possible to display uniform color over the entire screen even if its luminance is made low.

In addition, according to the present invention, even if the spectral transmittance of a faceplate is not uniform, it is possible to display uniform color over the entire screen.

Moreover, although the above description of the embodiments has referred to a dot type of color cathode ray tube, the present invention can also be applied to a stripe type of color cathode ray tube. In the case of the stripe type of color cathode ray tube, its stripe widths may be varied, respectively.

According to the present invention, it is possible to reduce the difference in luminance between the central and peripheral portions of the screen while retaining a landing margin in the peripheral portion of the screen.

In addition, according to the present invention, since the inner surface of the faceplate has a curvature, the shadow mask can be formed in a dome-like shape. Accordingly, it is possible to provide a cathode ray tube whose faceplate has an outer surface which looks flat, without reducing the strength of the shadow mask.

What is claimed is:

1. A cathode ray tube comprising a panel having a nearly flat outer surface and an inner surface which has an outward-convex curved surface, holes of a black matrix each of which corresponds to the color of one of phosphors for three colors being formed in the inner surface of the panel, wherein letting H1*c*, H2*c*, H1*d* and H2*d* be, respectively, a black matrix hole diameter corresponding to a phosphor for a first color in the center of a screen, a black matrix hole diameter corresponding to a phosphor for a second color in the center of the screen, a black matrix hole diameter corresponding to a phosphor for the first color in a diagonal periphery of the screen, and a black matrix hole diameter corresponding to a phosphor for the second color in the diagonal periphery of the screen, $$|H1d-H1c|\neq|H2d-H2c|,$$

where a difference in hole diameter for the first color between the center and the periphery and a difference in hole diameter for the second color between the center and the periphery are different from each other in a direction in which a difference in spectral transmittance between the center and the periphery of the panel is compensated for.

2. A color cathode ray tube according to claim 1, wherein the outer surface of the panel has an equivalent radius of curvature of 10,000 mm or more.

3. A color cathode ray tube according to claim 1, wherein the phosphor for the first color is a red phosphor and the phosphor for the second color is a green phosphor, and $|H1d-H1c|>|H2d-H2c|$.

4. A color cathode ray tube according to claim 1, wherein the phosphor for the first color is a red phosphor and the phosphor for the second color is a blue phosphor, and $|H1d-H1c|>|H2d-H2c|$.

5. A color cathode ray tube according to claim 1, wherein letting H3*c* and H3*d* be, respectively, a hole diameter corresponding to a phosphor for a third color in the center of the screen and a hole diameter corresponding to a phosphor for the third color in the diagonal periphery of the screen, the absolute value of $|H1d-H1c|-|H2d-H2c|$ is greater than the absolute value of $|H2d-H2c|-|H3d-H3c|$.

6. A color cathode ray tube according to claim 5, wherein the phosphor for the first color is a red phosphor.

7. A color cathode ray tube according to claim 5, wherein $|H2d-H2c|\cong|H3d-H3c|$.

8. A color cathode ray tube according to claim 1, wherein $|H1d-H2c|$ is greater than $|H1d-H2d|$.

9. A color cathode ray tube according to claim 8, wherein $H1d\cong H2d$.

10. A color cathode ray tube according to claim 1, wherein $|H1d-H2d|$ is greater than $|H1c-H2c|$.

11. A color cathode ray tube comprising a panel having a nearly flat outer surface and an inner surface which has an outward-convex curved surface, holes of a black matrix each of which corresponds to the color of one of phosphors for three colors being formed in the inner surface of the panel, wherein letting H1*c*, H2*c*, H1*d* and H2*d* be, respectively, a black matrix hole diameter corresponding to a phosphor for a first color in the center of a screen, a black matrix hole diameter corresponding to a phosphor for a second color in the center of the screen, a black matrix hole diameter corresponding to a phosphor for the first color in a diagonal periphery of the screen, and a black matrix hole diameter corresponding to a phosphor for the second color in the diagonal periphery of the screen, $|H1d-H1c|/H1c$ is greater than $|H2d-H2c|/H2c$ by 1.5% or more.

12. A color cathode ray tube according to claim 11, wherein $|H1d-H1c|/H1c$ is greater than $|H2d-H2c|/H2c$ by 3.0% or more.

13. A color cathode ray tube according to claim 11, wherein the outer surface of the panel has an equivalent radius of curvature of 10,000 mm or more.

14. A color cathode ray tube according to claim 11, wherein the phosphor for the first color is a red phosphor and the phosphor for the second color is a green phosphor, and $|H1d-H1c|>|H2d-H2c|$.

15. A color cathode ray tube according to claim 11, wherein the phosphor for the first color is a red phosphor and the phosphor for the second color is a blue phosphor, and $|H1d-H1c|>|H2d-H2c|$.

16. A color cathode ray tube according to claim 11, wherein letting H3*c* and H3*d* be, respectively, a hole diameter corresponding to a phosphor for a third color in the center of the screen and a hole diameter corresponding to a phosphor for the third color in the diagonal periphery of the screen, the absolute value of $|H1d-H1c|-|H2d-H2c|$ is greater than the absolute value of $|H2d-H2c|-|H3d-H3c|$.

17. A color cathode ray tube according to claim 16, wherein the phosphor for the first color is a red phosphor.

18. A color cathode ray tube according to claim 16, wherein $|H2d-H2c|\cong|H3d-H3c|$.

19. A color cathode ray tube according to claim 11, wherein $|H1c-H2c|$ is greater than $|H1d-H2d\uparrow$.

20. A color cathode ray tube according to claim 19, wherein $H1d\cong H2d|$.

21. A color cathode ray tube according to claim 11, wherein $|H1d-H2d|$ is greater than $|H1c-H2c|$.

* * * * *